US005618153A

United States Patent [19]

Lindgren

[11] Patent Number: 5,618,153

[45] Date of Patent: Apr. 8, 1997

[54] ARRANGEMENT PERTAINING TO THE TRANSPORTATION OF GOODS

[75] Inventor: Leif S. E. Lindgren, Billdal, Sweden

[73] Assignee: Floatline AB, Halmstad, Sweden

[21] Appl. No.: 325,211

[22] PCT Filed: Apr. 23, 1992

[86] PCT No.: PCT/SE92/00268

§ 371 Date: Oct. 21, 1994

§ 102(e) Date: Oct. 21, 1994

[87] PCT Pub. No.: WO93/22205

PCT Pub. Date: Nov. 11, 1993

[51] Int. Cl.[6] ..... A47F 5/10

[52] U.S. Cl. ..... 414/608; 294/67.32; 206/386; 206/598; 206/397; 108/53.5; 414/607; 414/911

[58] Field of Search ..... 414/607, 608, 414/626, 910, 911, 299; 108/51.1, 53.1, 53.3, 54.1, 56.1, 56.3, 52.1, 53.5; 206/557, 559, 565, 497, 804, 505, 506, 389, 391, 397, 400, 410, 597, 386, 598; 294/67.32, 81.52, 81.53

[56] References Cited

U.S. PATENT DOCUMENTS

| | | | |
|---|---|---|---|
| 718,506 | 1/1903 | Normandin | 294/67.32 |
| 2,443,684 | 6/1948 | Lazarus . | |
| 3,850,295 | 11/1974 | Black | 108/53.5 X |
| 3,913,735 | 10/1975 | Durbin | 206/598 X |
| 3,966,069 | 6/1976 | Fathauer | 414/607 |
| 4,257,523 | 3/1981 | Blasio | 206/386 X |
| 4,358,145 | 11/1982 | Svensson . | |
| 4,890,743 | 1/1990 | Powel et al. . | |

FOREIGN PATENT DOCUMENTS

| | | | |
|---|---|---|---|
| 535678 | 5/1973 | Czechoslovakia . | |
| 1416891 | 9/1965 | France . | |
| 1464115 | 11/1966 | France | 206/397 |
| 2657501 | 7/1977 | Germany . | |
| 2824929 | 12/1979 | Germany . | |
| 2924988 | 1/1980 | Germany . | |
| 414013 | 4/1980 | Sweden . | |
| 1076371 | 2/1974 | U.S.S.R. | 206/386 |
| WO8909171 | 10/1989 | WIPO . | |
| WO8912580 | 12/1989 | WIPO . | |

*Primary Examiner*—Frank E. Werner
*Attorney, Agent, or Firm*—Nies, Kurz, Bergert & Tamburro

[57] ABSTRACT

An arrangement for the transportation of goods, such as paper rolls, having a load carrier which includes a goods-carrying bottom plate.

The arrangement includes a lifting post (4) which is upstanding centrally from the bottom plate (2) and by which a loaded load-carrier can be lifted.

11 Claims, 5 Drawing Sheets

ARRANGEMENT PERTAINING TO THE TRANSPORTATION OF GOODS

BACKGROUND OF THE INVENTION

1. Field of the Invention

The present invention relates to an arrangement pertaining to the transportation of goods, such as paper rolls.

2. Description of the Related Art

The transportation of large paper rolls from the paper machine to the final consumer is encumbered with problems in the form of a large number of handling and trans-shipment or reloading operations, among other things. These operations are time-consuming, risk intensive and relatively often result in damage to the rolls.

The present invention provides a solution to these problems.

SUMMARY OF THE INVENTION

The invention thus relates to an arrangement pertaining to the transportation of goods, such as paper rolls, which includes a load carrier having a bottom plate intended for support said goods, for instance paper rolls.

The arrangement is mainly characterized by a lifting post by means of which the load carrier can be lifted, said lifting post being centrally located and protruding upward from the bottom plate.

BRIEF DESCRIPTION OF THE DRAWINGS

The invention will now be described in more detail with reference to exemplifying embodiments thereof and also with reference to the accompanying drawings, in which.

DESCRIPTION OF THE PREFERRED EMBODIMENTS

Figure 2:
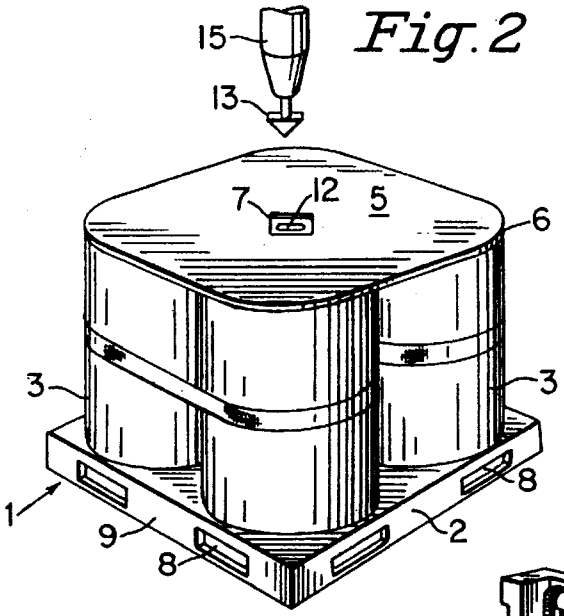
FIG. 2 illustrates the load carrier shown in FIG. 1 carrying a load of four paper rolls.
Figure 3:
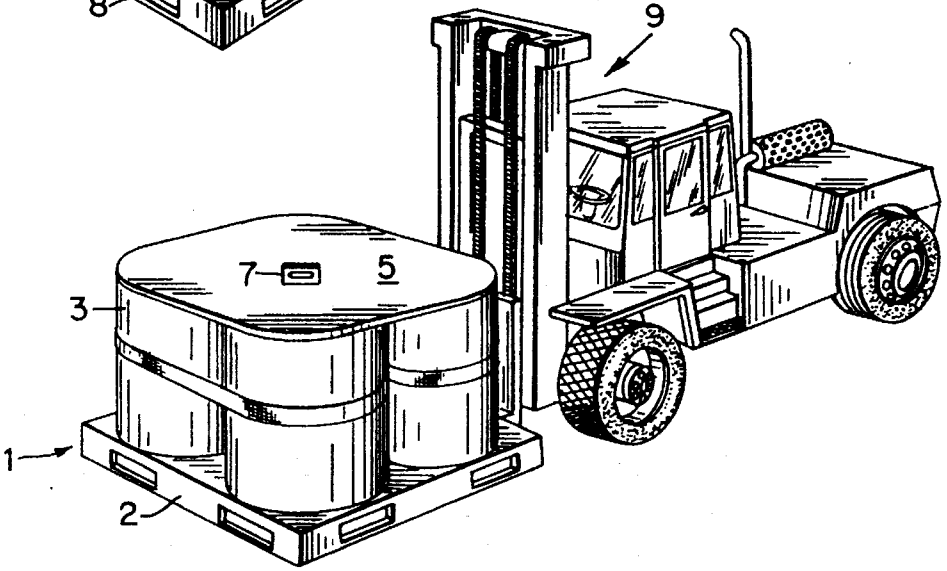
FIG. 3 illustrates handling of a load carrier with the aid of a fork-lift truck.
Figure 1:
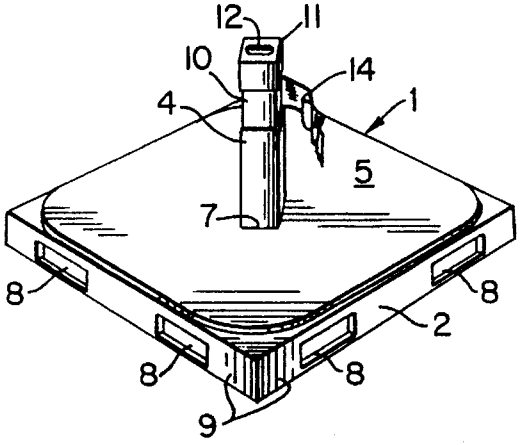
FIG. 1 is a schematic, perspective view of a first embodiment of an inventive unloaded load carrier.

FIG. 1 illustrates a load carrier 1 which includes a bottom plate 2 intended to support paper rolls 3 for instance, and a lifting post 4 which extends centrally u from the bottom plate. Also shown in the Figure is a cover plate 5 which, according to one preferred embodiment, is intended to cover or generally cover the upper surfaces 6 of the rolls placed on the bottom plate 2 (FIG. 2) and which includes an aperture 7 through which the lifting post 4 can be reached or project.

The bottom plate is provided with pockets 8 which accommodate the lifting forks of a fork-lift truck, said pockets preferably being provided on all sides 9 of the bottom plate.

It is preferred that the lifting post is removable from the bottom plate. In this regard, although not shown, the lifting post may be lockable to the bottom plate by means of a bayonet fitting or by some other suitable means. Subsequent to removing the lifting posts from respective bottom plates, the bottom plates can be stacked one upon the other for return to a depot, for instance. It is also preferred that the lifting posts can be extended and shortened, in order to be able to adapt the vertical extension of the post to differing heights/lengths of the paper rolls. For instance, the lifting post may have a telescopic construction in a suitable manner, although not shown.

Figure 8:
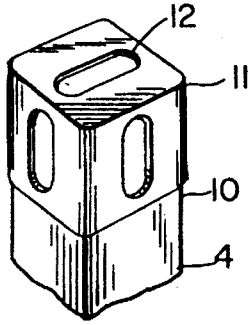
FIG. 8 illustrates schematically a hoist fitting for an inventive lifting post.

Mounted on the upper free end 10 of the lifting post is a hoist fitting 11. The hoist fitting is preferably adapted for container handling, wherein according to a preferred embodiment the fitting is essentially of the kind that is disposed in the corners of the container and comprises a housing, FIG. 8, having at least one upwardly facing elongated opening 12 through which a generally arrow-pointed lifting head 13 of a generally know kind can be inserted, wherein the head can be locked in engagement with the fitting by turning the head. Further turning of the head will bring it to a position in which it can be removed through said opening. The lifting head may be arranged generally in accordance with the teachings of Swedish Patent Specification No. 7904086-1, in which case the head is rotated or by being pressed against an internal bottom surface in the fitting. The load can be lifted by means of a truck or like machine provided with at least one horizontally and forwardly extending lifting head, with the aid of openings on the sides of the fitting.

The lifting post will preferably include a lashing 14 by means of which the load can be secured.

Figure 4:
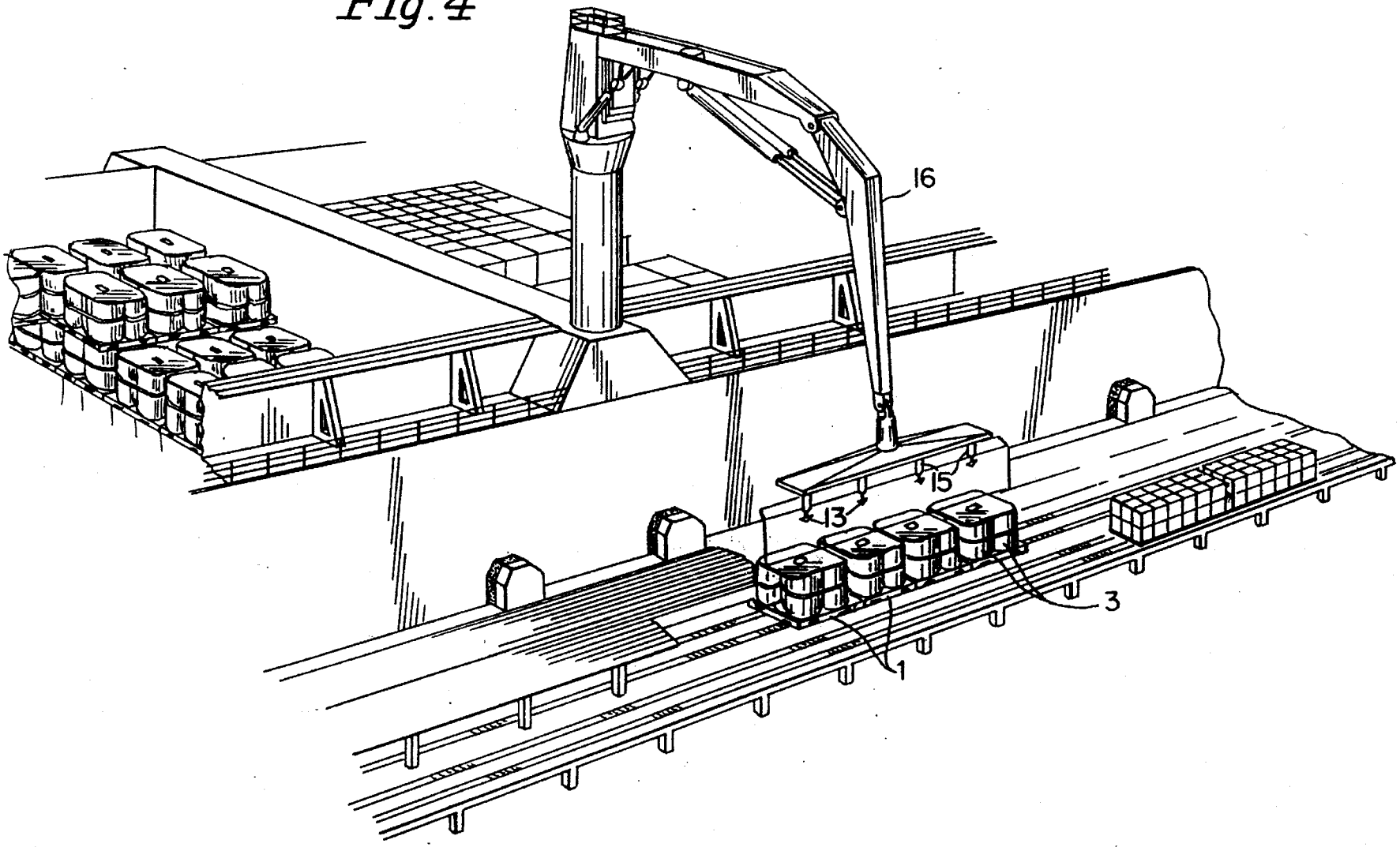
FIG. 4 illustrates handling of the load carrier in accordance with the invention, with the aid of a crane arrangement.

FIG. 4 illustrates a lifting device 15 which is intended for coaction with a lifting arrangement 16, in the illustrated case a crane arrangement 16, and at least one load carrier, in the illustrated case four carriers. The Figure illustrates an embodiment in which the lifting device is provided with lifting heads 13 of the aforesaid kind. Shown in FIG. 5 is a lifting device 15 of generally the same kind which is mounted, instead, on a lifting arrangement in the form of a traverse 17.

Figure 5:
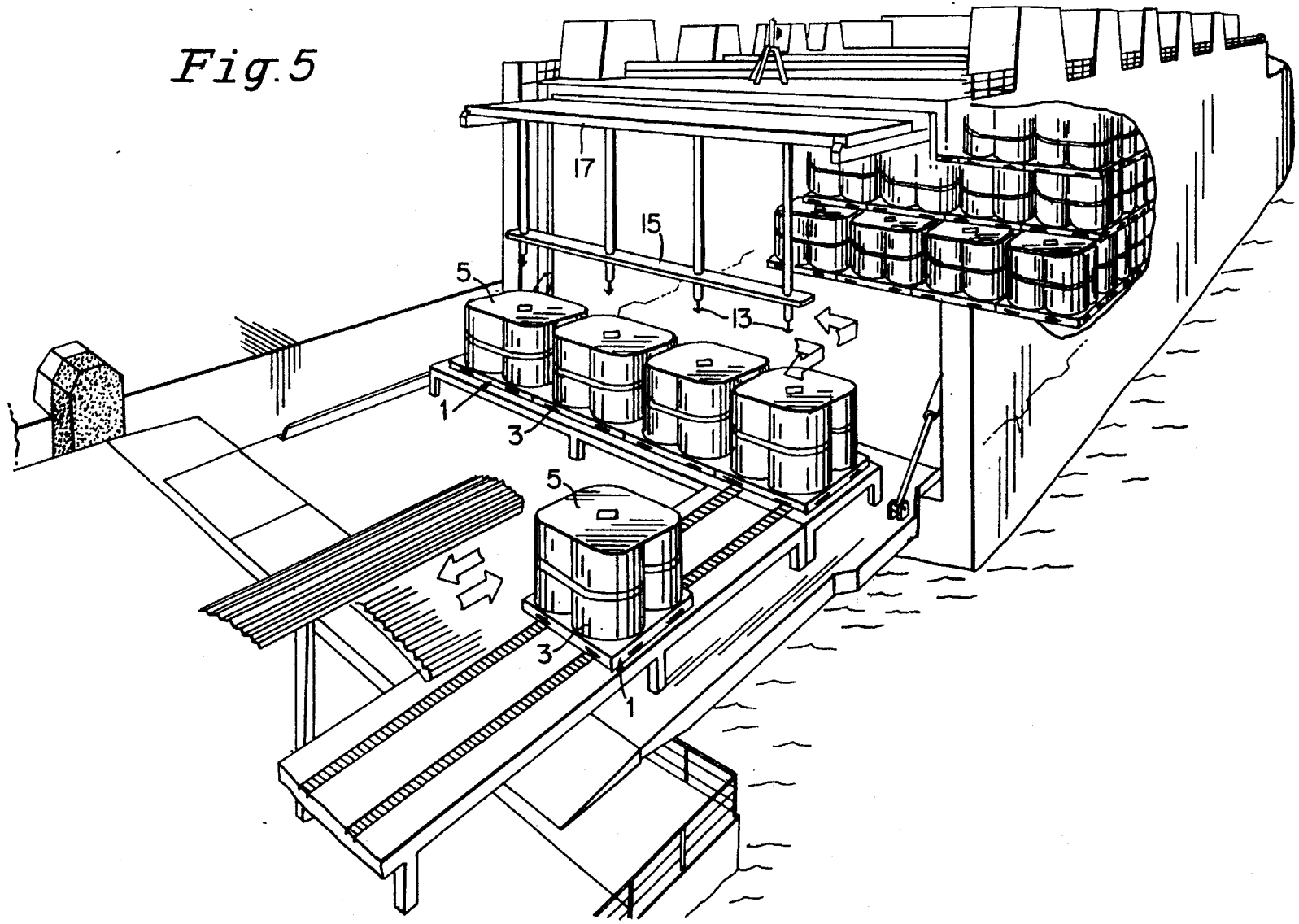
FIG. 5 illustrates handling of load carriers in accordance with the invention with the aid of a traverse hoist arrangement.
Figure 6:
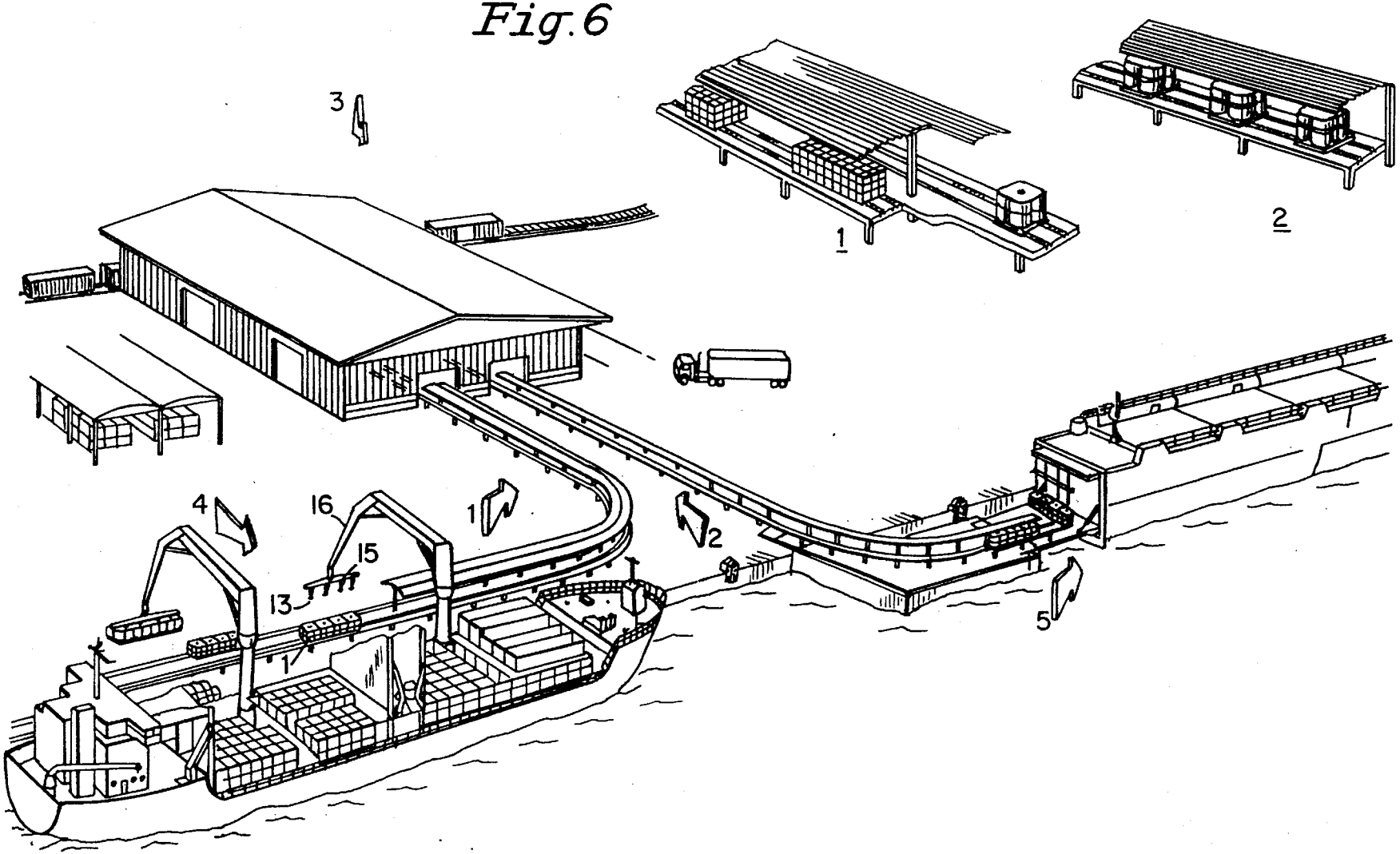
FIG. 6 illustrates a combination of material handling situations.
Figure 7:
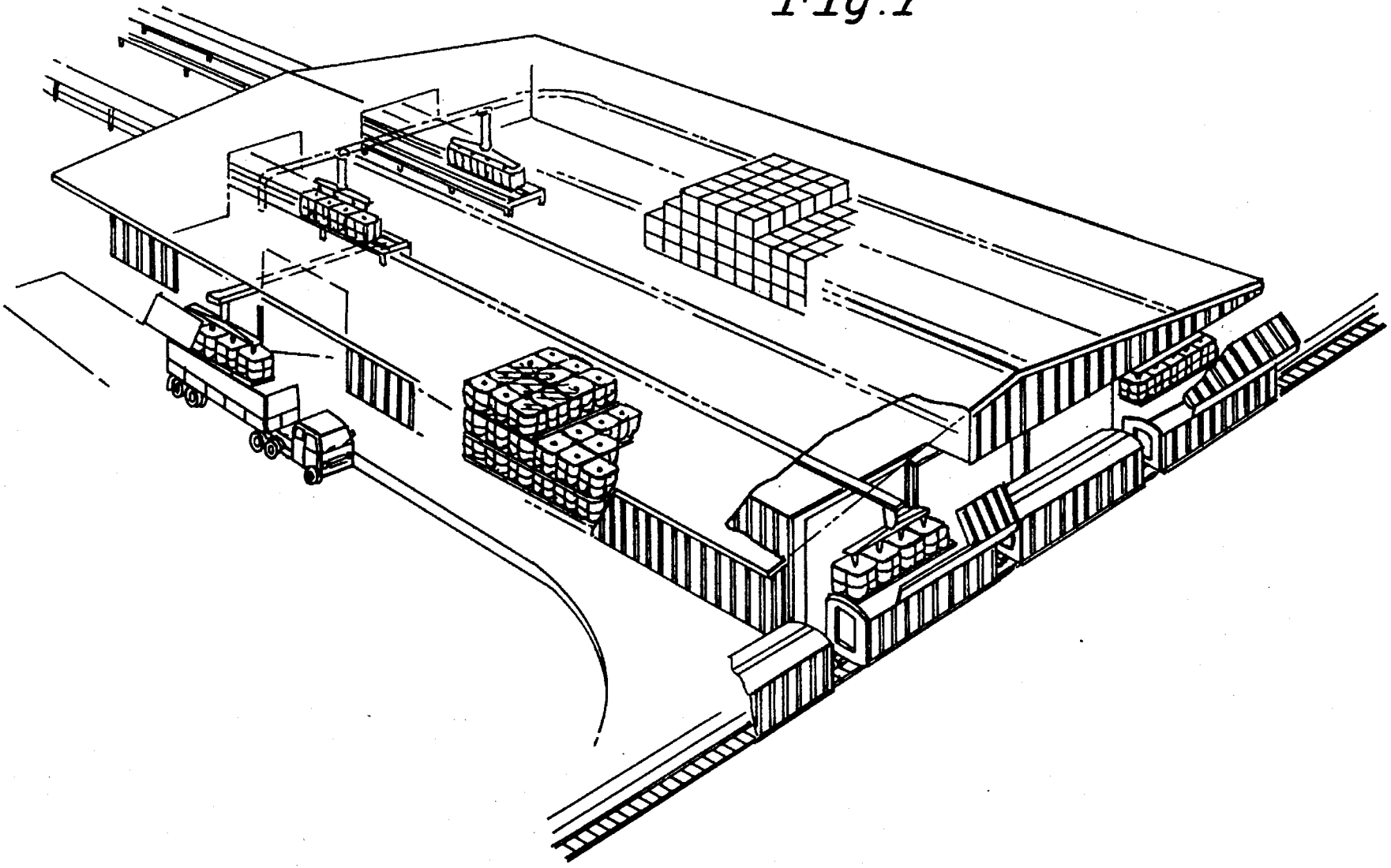
FIG. 7 illustrates schematically a warehouse in accordance with FIG. 6.

FIGS. 4, 5 and 6 illustrate different loading and unloading situations in which inventive arrangements are used.

The method in which the inventive arrangement works will be understood essentially from the aforegoing. The intention is that the paper rolls are placed on the load carriers already in the proximity of the paper machine and are not removed from the load carriers until they are used finally in a printing hall or some like place. All reloading, trans-shipment and transportation shall be effected with the load carriers and not with the rolls themselves. Lifting is effected with the aid of the lifting post. The rolls are protected by the cover plate or cover sheet, which also forms a friction-enhancing element when stacking several load carriers one on the other.

It will be evident from the aforegoing that the invention provides advantages in the form of eliminating risks and damage, in comparison with known techniques. The invention also enables loading/unloading operations, for example quay-side operations to be fully automated, thereby eliminating the need of separate stowing personnel.

Although the invention has been described in the aforegoing essentially with reference to an exemplifying embodiment thereof, it will be understood that other embodiments and minor modifications are conceivable without departing from the inventive concept.

With regard to the construction of the bottom plates and the material from which they are made, the plates are preferably of lightweight construction, such as a sandwich-type construction, made of steel, light metal, fiberglass glass material or some similar appropriate material.

It is conceivable to use some other device than the lifting post, for instance an eye or the like which coacts with a lifting hook. The described and illustrated system, however, enables operations to be automated.

According to one embodiment which is preferred in certain cases, the bottom plate for instance is provided with devices which enable at least two adjacent load carriers to be connected together for supporting, for instance, long goods, such as packaged wood.

The load carrier is also suitable for carrying bag-like containers, such as so-called jumbo bags (not shown) containing, for instance, granular products. According to one embodiment of such sack-like containers adapted to the load carrier, the container has a centrally located channel which is intended to be fitted over the lifting post and through which the lifting post is thus intended to extend, thereby holding the container to the load carrier.

The invention is thus not restricted to the aforedescribed and illustrated embodiments thereof since modifications are possible within the scope of the following Claims.

What is claimed is:

1. An arrangement for transportation of goods, comprising a load carrier which includes a carrying bottom plate, and a lifting post which is upstanding centrally from the bottom plate and is mounted thereto, wherein the lifting post includes a hoist fitting for lifting the load carrier and a lashing band for securing goods to the bottom plate, wherein the load carrier includes a cover plate having an aperture through which the post can extend such that the cover plate is slidable axially along and removable from said post, whereby the cover plate protects upper surfaces of goods placed on the bottom plate.

2. An arrangement according to claim 1, wherein the lifting post is removably mounted.

3. An arrangement according to claim 1, wherein the height of the lifting post can be changed.

4. An arrangement according to claim 1, wherein the hoist fitting includes a housing having an upwardly facing, elongated opening through which a generally arrowheaded lifting head is intended to be inserted and locked by rotation and released by further rotation, said rotational movement being effected by pressing the head against an internal bottom surface of the housing.

5. An arrangement according to claim 1, including a lifting device connected with the hoist fitting for lifting and transporting a load carried on the bottom plate.

6. An arrangement according to claim 1, wherein the bottom plate includes a substantially square load-supporting surface to receive and support four paper rolls disposed in an essentially square array.

7. An arrangement according to claim 1, wherein the bottom plate includes a plurality of pockets for receiving lifting forks of a fork-lift truck.

8. An arrangement according to claim 1, wherein the lifting post has an upper free end and the hoist fitting is mounted on the upper free end of the lifting post.

9. An arrangement according to claim 8, wherein the hoist fitting includes an upwardly facing elongated opening to receive a lifting head that is movable to extend into the elongated opening and is rotatable between a first, lifting position in which the lifting head engages the hoist fitting, and a second, non-lifting position in which the lifting head is removable from the hoist fitting through the elongated opening.

10. An arrangement according to claim 8, wherein the hoist fitting has a generally upstanding side that includes an elongated opening for receiving a lifting head.

11. An arrangement according to claim 8, wherein the hoist fitting includes an upwardly facing first elongated opening to receive a rotatable lifting head that is vertically movable to extend into the first elongated opening and is rotatable between a first, lifting position in which the lifting head engages the hoist fitting, and a second, non-lifting position in which the lifting head is removable from the hoist fitting through the first elongated opening, and wherein the hoist fitting has a generally upstanding side that includes a second elongated opening for receiving a laterally movable lifting head.

* * * * *